United States Patent [19]

Plummer

[11] Patent Number: 4,555,327

[45] Date of Patent: Nov. 26, 1985

[54] CRACKING WITH TETRACHLOROALUMINATE CATALYSTS AND WATER

[75] Inventor: Mark A. Plummer, Littleton, Colo.

[73] Assignee: Marathon Oil Company, Findlay, Ohio

[21] Appl. No.: 627,154

[22] Filed: Jul. 2, 1984

[51] Int. Cl.[4] ..... C10G 11/08; C10G 47/08

[52] U.S. Cl. ..... 208/108; 208/117; 585/742

[58] Field of Search ..... 208/115, 116, 117, 108, 208/230, 248; 585/741, 742

[56] References Cited

U.S. PATENT DOCUMENTS

| | | | |
|---|---|---|---|
| 1,815,460 | 7/1931 | Chappell | 208/73 |
| 1,825,294 | 9/1931 | Wolcott | 208/117 |
| 2,113,028 | 4/1938 | Kuentzel | 423/116 |
| 2,125,235 | 7/1938 | Atwell | 585/517 |
| 2,146,667 | 2/1939 | Atwell | 585/532 |
| 2,342,073 | 2/1944 | Cheney | 585/742 |
| 2,360,700 | 10/1944 | McAllister et al. | 208/117 |
| 2,369,444 | 2/1945 | d'Ouville et al. | 208/46 |
| 2,388,007 | 10/1945 | Pardee et al. | 585/460 |
| 2,394,898 | 2/1946 | Cheney et al. | 585/742 |
| 2,768,935 | 10/1956 | Watkins | 208/113 |
| 3,324,192 | 6/1967 | Roebuck et al. | 585/460 |
| 3,501,416 | 3/1970 | Wald | 502/164 |
| 3,677,932 | 7/1973 | Hardesty et al. | 208/108 |
| 3,764,515 | 10/1973 | Kiovsky | 208/10 |
| 3,966,582 | 6/1976 | Cramer | 208/8 |
| 4,247,385 | 1/1981 | Gorin | 208/10 |
| 4,317,712 | 3/1982 | Farcasiu | 208/46 |
| 4,333,815 | 6/1982 | Vermeulen et al. | 208/10 |

OTHER PUBLICATIONS

Alul et al., "Alkylation of Benzene with 8-methyl-1-nonene, V. Effect of the Catalyst on the Isomerization of Secondary Carbonium Ions", *J. Org. Chem.*, vol. 37, No. 25, 1972.

Bugle et al., "Oil-shale Kerogen: Low Temperature Degradation in Molten Salts," *Nature*, vol. 274, No. 5671, pp. 578–580, 1978.

Boehme et al., "Optimal Insertion of Liquid Catalysts Based on Aluminum Chloride into Cationic Hydrocarbon Reactions," *Chem. Abstracts*, vol. 89, 1978, No. 89:460 83V.

Brown, H. C. and H. Pearsall, "The Catalytic Halides, I. A. Study of the Catalyst Couple, Aluminum Chloride–Hydrogen Chloride, and the Question of the Existence of $HAlCl_4$," *J. Am. Chem. Soc.*, 73–4681–4683 (1951).

Lien et al., "Rate of Isomerization of Cyclohexane," *Ind. and Eng. Chem.*, vol. 44, pp. 351–353, (Feb. 1952).

Richardson, R. L., and S. W. Benson, "A Study of the Hydrogen Chloride–Aluminum Chloride Systems," *J. Am. Chem. Soc.*, 73–5096–9 (1951).

*Primary Examiner*—D. E. Gantz
*Assistant Examiner*—O. Chaudhuri
*Attorney, Agent, or Firm*—Jack L. Hummel; Rodney F. Brown

[57] ABSTRACT

A process for producing lower molecular weight products from a heavy hydrocarbon feedstock is provided wherein the feedstock is contacted with a molten catalyst system comprising a tetrachloroaluminate catalyst and about 1 to about 25 mole percent water. The reaction is carried out at a pressure of from about atmospheric to about 14,200 kPa and a temperature of from about 350° C. to about 550° C. resulting in increased yields of the lower molecular weight liquid products and lower levels of catalyst residue.

19 Claims, No Drawings

CRACKING WITH TETRACHLOROALUMINATE CATALYSTS AND WATER

DESCRIPTION

1. Technical Field

This invention relates to a process for reducing the molecular weight of a heavy hydrocarbon feedstock into more desirable lower molecular weight products and, in particular, to a process using a catalyst system containing a tetrachloroaluminate catalyst and a limited amount of water.

2. Background Art

Of the many processes which convert heavy hydrocarbon feedstock components into lower average molecular weight, more useful, hydrocarbon products, most involve cracking or hydrogenating the feed materials in the presence of a catalyst. These processes generally consume expensive hydrogen and/or reject carbon to a low value product. Exemplary processes are described in U.S. Pat. Nos. 3,966,582; 2,768,935; 4,317,712; 4,333,815; 1,825,294 and 3,764,515. These patents teach a wide variety of halide salts and mixtures thereof as reaction catalysts. U.S. Pat. Nos. 4,317,712 and 4,333,815 disclose mixing aromatic hydrocarbons with a coal or petroleum oil feedstock. The mixture is subsequently cracked using $ZnCl_2$ or $AlCl_3$ as Friedel-Crafts catalysts. U.S. Pat. Nos. 1,825,294 and 3,764,515 disclose using a gaseous mineral acid, such as HCl, as a promoter for the $ZnCl_2$ or $AlCl_3$ cracking catalysts.

Sodium tetrachloroaluminate ($NaAlCl_4$) is a known catalyst for a number of reactions. For example, U.S. Pat. Nos. 2,125,235 and 2,146,667 disclose polymerizing hydrocarbon gases, e.g., olefins, with an $NaAlCl_4$ catalyst. U.S. Pat. No. 2,342,073 discloses the use of $NaAlCl_4$ for isomerizing paraffins with an $NaAlCl_4$ catalyst. U.S. Pat. Nos. 2,388,007 and 3,324,192 teach alkylating aromatic hydrocarbons with an $NaAlCl_4$ catalyst. U.S. Pat. No. 2,113,028 teaches a method of regenerating double halide catalysts such as $NaAlCl_4$. $NaAlCl_4$, having an excess of NaCl, is utilized as a heat transfer medium in a process to produce raw shale oil from oil shale. See R. C. Bugle, et al., *Nature,* Vol. 274, No. 5671, pp. 578–580.

Hydrogen tetrachloroaluminate ($HAlCl_4$) is likewise a known catalyst for at least a small number of reactions, e.g., isomerization and condensation reactions. Lien et al., in an article entitled "Rate of Isomerization of Cyclohexane," *Industrial and Engineering Chemistry,* Vol. 44, pp. 351–353 (Feb. 1952), disclose the effects of $AlCl_3$ and HCl catalysts under varying conditions on the rate of isomerization. Alul et al., "Alkylation of Benzene with 8-Methyl-1-nonene. V. Effect of the Catalyst on the Isomerization of Secondary Carbonium Ions," *J. Org. Chem.,* Vol. 37, No. 25, 1972, teach that $AlCl_3$ in conjunction with HCl is a very strong catalyst which isomerizes secondary alkylbenzenes and dealkylates the tertiary isomer. Other catalytic uses of $AlCl_3$ and HCl are disclosed in "Optimal Insertion of Liquid Catalysts Based on Aluminum Chloride into Cationic Hydrocarbon Reactions," Boehme et al., *Chemical Abstracts,* Vol. 89, 1978, No. 89:46083V; "A Study of the Hydrogen Chloride-Aluminum Chloride System," by Ryden L. Richardson and Sidney W. Benson, *J. Am. Chem. Soc.,* 73-5096-9 (1951); and "The Catalytic Halides. I. A Study of the Catalyst Couple, Aluminum Chloride-Hydrogen Chloride, and the Question of the Existence of $HAlCl_4$," by Herbert C. Brown and Howard Pearsall, *J. Am. Chem. Soc.,* 73-4681-3 (1951).

Despite the apparent proliferation of catalytic processes for cracking or hydrogenating heavy hydrocarbons, a need exists for an improved catalyst which can reduce the molecular weight of a heavy hydrocarbon feedstock to increase the yield of the more desirable lower molecular weight hydrocarbon products. More specifically a process is needed wherein the activity of a tetrachloroaluminate catalyst is substantially improved.

DISCLOSURE OF THE INVENTION

The present invention is a process utilizing a tetrachloroaluminate catalyst to reduce the molecular weight of a heavy hydrocarbon liquid feedstock wherein the activity of the catalyst is substantially improved by maintining a limited amount of water in the catalyst system. The yield of desirable lower molecular weight hydrocarbon products is increased and undesirable catalyst residue is correspondingly decreased by employing a catalyst system containing the tetrachloroaluminate catalyst and water in a molar concentration from about 1 to about 25 mole percent. The water concentration can be attained by adding water to the catalyst during its manufacture and/or during the molecular weight reduction process.

BEST MODE FOR CARRYING OUT THE INVENTION

According to the present invention, a molten catalyst system comprised of a limited amount of water and a tetrachloroaluminate catalyst is utilized to reduce the molecular weight of a heavy hydrocarbon liquid feedstock into lower molecular weight hydrocarbon products. The presence of water in the molten catalyst system substantially improves the activity of the catalyst with respect to the hydrocarbon feedstock. As used herein, the term "molten catalyst system" refers only to the molten liquids and fluid constituents retained therein. It does not include overhead vapors boiling off of the liquids.

The feedstock materials useful in the practice of the present invention are heavy or high molecular weight hydrocarbons which are typically viscous liquids, such as liquefied or solvent refined coal, asphalt, including asphaltenes and preasphaltenes, tar, shale oil, petroleum residual oils, oils extracted from tar sands, and heavy petroleum crude oils boiling below about 850° C. While this process is most advantageously applied to petroleum residuals and shale oils, in general virtually any hydrocarbon feedstock which can be liquefied at the process conditions specified below can be utilized herein.

The catalyst is a tetrachloroaluminate catalyst defined herein as a compound or a mixture of compounds, each compound containing a tetrachloroaluminate anion and an appropriate metal cation other than aluminum. The cation can be selected on the basis of its electronegativity to provide the tetrachloroaluminate catalyst with a desired polarity so that the catalyst will be relatively specific to reacting certain feedstock components and producing recoverable products. Exemplary catalysts include $NaAlCl_4$, $KAlCl_4$, $Zn(AlCl_4)_2$, and mixtures thereof. In combination with any of the tetrachloroaluminate catalysts, $HAlCl_4$ may be used as a co-catalyst.

According to one embodiment, the tetrachloroaluminate catalyst is manufactured by mixing aluminum chloride ($AlCl_3$) with a second different metal chloride salt, e.g., NaCl, $ZnCl_2$, KCl, etc., in about a one to one molar ratio at about 155° to about 225° C. for about 5 to about 30 minutes to produce the molten tetrachloroaluminate catalyst. It is essential that substantially all of the second metal chloride salt is converted to the tetrachloroaluminate catalyst so that substantially no excess unreacted second metal chloride salt remains in the catalyst system when it is contacted with the hydrocarbon feedstock. To ensure this, the tetrachloroaluminate catalyst is preferably made by using a molar ratio of $AlCl_3$ to the second metal chloride salt slightly greater than one to one such that there is about 1 to 10 mole percent excess of $AlCl_3$ in the reaction mixture. During the course of the reaction substantially all of the second metal chloride salt is converted to the tetrachloroaluminate catalyst. The excess $AlCl_3$ is not retained in the molten catalyst system because within the recited temperature range substantially all of the excess $AlCl_3$ is vaporized from the molten catalyst system.

Water is added to the catalyst system during manufacture of the catalyst and/or during the molecular weight reduction process in an amount such that the resulting catalyst system contains from about 1 to about 25 mole percent water and preferably from about 5 to about 15 mole percent water. Because some water may be consumed during the molecular weight reduction process, water can be added sequentially or continuously throughout the process to maintain the concentration of water in the catalyst system within the specified range. It is essential that at no time during the process does the amount of water in the catalyst system exceed 25 mole percent.

The process for converting heavy liquid hydrocarbons into lower molecular weight products is most advantageously operated at pressures from about atmospheric to about 14,200 kPa (about 1 atm to about 140 atm), preferably from about 200 to about 14,200 kPa (about 2 to about 140 atm), and most preferably from about 700 to about 7100 kPa (about 7 to about 70 atm). These pressures represent a significant decrease from those required in most commercial molecular weight reduction processes via hydrogenation. The reaction temperature at which the feedstock and catalyst system are contacted is about 350° to about 550° C., and preferably about 400° to about 455° C. The contact time of the hydrocarbon feedstock with the catalyst system is from about 0.25 to about 4.0 hours (pound catalyst per pound feed per hour).

Selection of the molecular weight reduction conditions and the composition of the catalyst system is dependent to some extent upon the nature of the feed material, but is primarily dependent on the desired average molecular weight of the products and on the desired level of contaminant (i.e., sulfur, nitrogen, and oxygen) removal. The term "products" as used herein refers to the mixture of hydrocarbon compounds obtained from the catalytic reaction of the feedstock and "product" refers to an individual compound within the mixture. In many cases, it is preferable that the products have a hydrogen to carbon ratio greater than that of the feedstock. It is also preferable that the hydrocarbon products are a liquid mixture, each liquid having a melting point below about 200° C. Exemplary liquids are refined products having a boiling range below about 540° C., e.g., gasoline, kerosene, gas oil and the like. The molecular weight of substantially each individual product is below the molecular weight range of the hydrocarbon feedstock or alternatively the average molecular weight of the liquid products is less than the average molecular weight of the hydrocarbon feedstock although an individual product may have a molecular weight within the range of the hydrocarbon feedstock. Finally, in view of the preference for liquid hydrocarbon products, it is desirable to minimize the conversion of hydrocarbon feedstock to catalyst residue.

In operation, the process employs a purge gas, which is typically recycled, to remove the liquid products from the catalyst system. The purge gas, present in an amount sufficient to effect product removal, is either an inert gas, such as nitrogen, helium and the other Inert Gases of the Periodic Table, methane and other low molecular weight paraffins, etc., or a reactive gas, such as hydrogen, carbon monoxide, and low molecular weight aromatics and olefins. Mixtures of inert and reactive gases can also be used. The purge gas can also contain a quantity of hydrogen chloride gas to counteract the introduction of oxygen as a hydrocarbon feedstock contaminant. Oxygen undesirably converts the catalyst from the chloride to the oxide form.

It is believed that the catalyst system of the present invention catalyzes both the reduction of the hydrocarbon feedstock to lower molecular weight products and the hydrogenation of the resulting products. Accordingly, it is believed that the catalyst system initially catalyzes formation of free radicals from a portion of the feed. The free radicals react via a series of possible mechanisms, such as isomerization, alkylation, polymerization, etc., to form a liquid product primarily comprising branched paraffins, aromatics and naphthenes.

At this point in the reaction, a tetrachloroaluminate catalyst system containing no water retains a significant portion of the feedstock, e.g., 20 to 30%, as a residue. If the residue was formed by coking, hydrogen would be removed from a portion of the feedstock to hydrogenate the liquid product. Since the residue has a hydrogen to carbon (H/C) ratio of about 0.9 to 1, it appears that the residue is not formed primarily by coking. Apparently when the tetrachloroaluminate catalyst system is used without water, significant levels of N, O or S contaminants present in the feedstock are recovered with the products and the hydrocarbon radicals formed undergo polymerization to catalyst residue. Addition of a hydrogen gas overpressure does little to reduce the amount of feedstock retained as residue by the catalyst, which indicates that adding hydrogen gas to the reaction atmosphere does not significantly assist in hydrogenation of the hydrocarbons.

In comparison, practice of the present invention provides water at the tetrachloroaluminate catalyst surface. The water appears to be a source of hydrogen ions for the hydrocarbon radicals formed at the surface. The hydrogen, among other things, lessens the polymerization of these radicals thereby enhancing production and/or recovery of lower average molecular weight products and minimizing the retention of residue on the catalyst surface. Thus, the need for frequent catalyst regeneration to drive off residue is reduced.

It is particularly important that the molar cncentration of water in the catalyst system does not exceed the molar concentration prescribed herein. Although, as noted above, the presence of a limited amount of water beneficially provides a hydrogen ion source, too much water appears to promote the formation of undesirable catalyst degradation products which diminsh the effectiveness of the catalyst. For example, degradation products of $NaAlCl_4$ include NaOH, HCl and $Al(OH)_3$.

These and other aspects of the invention may be best understood by reference to the following examples which are offered by way of illustration and not by way of limitation.

EXAMPLE 1

NaCl and $AlCl_3$ in a molar ratio of 1.0 to 1.02 are dried for 5 hours at 90° C. and full vacuum. The dried ingredients are then combined with gaseous HCl to form an $NaAlCl_4/HAlCl_4$ catalyst system having 5.8% $HAlCl_4$ and 94.2% $NaAlCl_4$ by weight. The catalyst system is then used to reduce the molecular weight of a shale oil feed. The shale oil feed is converted to the following components (the amounts are weight %):

| Hydrocarbon Products | | Catalyst | Removed |
|---|---|---|---|
| Liquid | Gas | Residue | S, N and O Contaminants |
| 66.5 | 1.5 | 30.0 | 2.0 |

EXAMPLE 2

The ingredients of the $NaAlCl_4/HAlCl_4$ catalyst system are combined in the same proportions as Example 1 except that the ingredients are not dried beforehand. The $NaAlCl_4/HAlCl_4$ catalyst system contains 1.1±0.2% water on a weight basis and 10.5±2.8% water on a mole basis. The molecular weight of the shale oil feed of Example 1 is then reduced in the presence of this catalyst. The shale oil feed is converted to the following components (the amounts are weight %):

| Hydrocarbon Products | | Catalyst | Removed |
|---|---|---|---|
| Liquid | Gas | Residue | S, N and O Contaminants |
| 80.0 | 1.5 | 15.8 | 2.7 |

The presence of water in the catalyst system substantially increases the liquid product yield while decreasing the catalyst residue.

Although the foregoing invention has been described by way of example for purposes of clarity of understanding, it will be obvious that certain changes and modifications may be practiced within the scope of the invention, as limited only by the scope of the appended claims.

I claim:

1. A process for producing lower molecular weight products from a higher molecular weight hydrocarbon liquid feedstock comprising:

contacting the higher molecular weight hydrocarbon liquid feedstock with a molten catalyst system at a pressure from about atmospheric to about 14,200 kPa and a temperature from about 350° to 550° C. for a contact time sufficient to produce the lower molecular weight products wherein the molten catalyst system is comprised of a tetrachloroaluminate catalyst and water at a molar concentration from about 1 to about 25 percent and is substantially free of a metal chloride salt used in the manufacture of the tetrachloroaluminate catalyst.

2. The process of claim 1 wherein the molar concentration of water in the catalyst system is from about 5 to about 15%.

3. The process of claim 1 wherein an amount of water is added to the catalyst system during manufacture of the tetrachloroaluminate catalyst and wherein said amount of water is sufficient to maintain said molar water concentration in the catalyst system.

4. The process of claim 1 wherein an amount of water is added to the catalyst system while contacting the feedstock with the catalyst system and wherein said amount of water is sufficient to maintain said molar water concentration in the catalyst system.

5. The process of claim 1 wherein the tetrachloroaluminate catalyst is selected from the group consisting of $NaAlCl_4$, $Zn(AlCl_4)_2$, $KAlCl_4$, and mixtures thereof.

6. The process of claim 1 wherein the catalyst system contains an $HAlCl_4$ co-catalyst.

7. The process of claim 1 wherein the temperature is from about 400° C. to about 455° C.

8. The process of claim 1 wherein the pressure is from about 700 to about 7100 kPa.

9. The process of claim 1 wherein the contact time between the hydrocarbon feedstock and the catalyst system is from about 0.25 to about 4.0 hours.

10. The process of claim 1 wherein the higher molecular weight feedstock comprises at least one heavy liquid hydrocarbon selected from the group consisting of liquefied or solvent refined coal, asphalt, asphaltenes, preasphaltenes, tar, shale oil, petroleum residual oils, oils extracted from tar sands, heavy petroleum crude oils boiling below about 850° C., and mixtures thereof.

11. The process of claim 1 further comprising separating the products from the catalyst system by purging with a purge gas.

12. The process of claim 11 wherein at least a portion of the purge gas is reactive.

13. The process of claim 12 wherein the reactive purge gas is selected from the group consisting of hydrogen, carbon monoxide, low molecular weight aromatics, low molecular weight olefins, and mixtures thereof.

14. The process of claim 11 wherein the purge gas is inert.

15. The process of claim 14 wherein the inert purge gas is selected from the group consisting of nitrogen, helium, methane and other low molecular weight paraffins, and mixtures thereof.

16. The process of claim 11 wherein the purge gas is separated from the products and recycled.

17. The process of claim 1 wherein the hydrogen to carbon ratio of the products is greater than the hydrogen to carbon ratio of the hydrocarbon feedstock.

18. The process of claim 1 wherein the products have a lower average molecular weight than the average molecular weight of the feedstock.

19. The process of claim 1 wherein substantially each product has a molecular weight below the molecular weight range of the feedstock.

* * * * *